United States Patent [19]

Hopfer

[11] Patent Number: 4,697,351

[45] Date of Patent: Oct. 6, 1987

[54] ADJUSTABLE LAYOUT SQUARE

[76] Inventor: David M. Hopfer, 2876 Cloverdale Rd., Turner, Oreg. 97392

[21] Appl. No.: 9,740

[22] Filed: Feb. 2, 1987

[51] Int. Cl.[4] ..... B43L 7/06

[52] U.S. Cl. ..... 33/420; 33/427

[58] Field of Search ..... 33/420, 418, 419, 427, 33/464, 173

[56] References Cited

U.S. PATENT DOCUMENTS

| | | | |
|---|---|---|---|
| 795,160 | 7/1905 | Nicholls | 33/420 |
| 1,509,703 | 9/1924 | Bourgeois | 33/427 |
| 2,448,440 | 8/1948 | King | 33/427 |

*Primary Examiner*—Harry N. Haroian

*Attorney, Agent, or Firm*—Harvey B. Jacobson

[57] ABSTRACT

An adjustable square assembly has a framing square with orthogonal limbs, slide fittings for mounting on the respective limbs with an adjustable angle blade therebetween and a tri-square blade and body for adjustable mounting on one of the limbs so that the tri-square blade is in parallel with the other limb of the framing square. One limb of the framing square has a single groove which cooperates with one of the slide carriers as a means whereby the carrier can be adjustably clamped in place through a locking screw on the carrier. The other limb is wider and has a pair of grooves so that the other limb can take the slide carrier in one of the grooves and the framing square body in the other groove. All the parts are reversible so that the slide carriers can be mounted on either limb of the framing square and can operate either along the inner and outer edges of the respective limbs. Similarly the tri-square body can be mounted on either limb to operate either on the inner or outer edges of the respective limbs.

6 Claims, 8 Drawing Figures

ADJUSTABLE LAYOUT SQUARE

BACKGROUND OF THE INVENTION

This invention relates in general to adjustable layout squares, namely instruments which can be used in diverse applications for measuring and setting out markings on a workpiece at predetermined angles and/or distances. For example, adjustable layout squares can be used in drafting or generally in setting out patterns on wooden workpieces in carpentry work or on steel plate in sheetmetal work and the like.

Squares of many different designs are known in the art. Commonly known forms of squares, for example, include right angle or framing squares, comprising orthogonally disposed limbs or blades each marked with a scale, set squares of triangular form usually having a pair of orthogonal sides and a hypotenuse at a specified angle, such as 45° or 60°, and adjustable set squares in which the angle of the hypotenuse can be varied. Adjustable squares or bevels comprising an orthogonal framing square with an extra blade which can be slid along the respective limbs to vary its angle are also known. Thus, certain such known instruments are disclosed, for example in the following U.S. patents:

| | |
|---|---|
| 820,311 | May 8, 1906 |
| 824,821 | July 3, 1906 |
| 866,111 | Sept. 17, 1907 |
| 973,584 | Oct. 25, 1910 |
| 1,039,057 | Sept. 17, 1912 |
| 1,674,882 | June 26, 1928 |
| 4,028,814 | June 14, 1977 |

SUMMARY OF THE INVENTION

Although the patents referred to above show a variety of different layout and similar instruments, including adjustable angle squares, little attenion appears to have been directed to the marking of points on parallel lines. Commonly, this is done, for example, using a framing square and a separate set square and the like which must be manually held in place, and difficulties often arise, for example, in holding the squares together in one hand without slipping while marking out the work with the other hand.

It is a primary object of the present invention to provide a novel form of layout instrument or square assembly which provides for the marking of variable angles and also parallel lines without having to hold two separate instruments simultaneously, which is simple to use, and which is of sturdy construction.

Another object of the invention is to provide a novel form of adjustable square comprising a framing square with orthogonal blades or limbs, slide fittings for the respective limbs, and an adjustable angle blade for connection between the fittings, and which can have its angle adjusted by sliding movement of the respective fittings along the respective limbs of the framing square, and wherein the slide fittings can be reversed for use on either blade of the framing square and for sliding along inner or outer edges of the respective blades with the angle blade connected therebetween to provide versatility in mounting of the slide fittings and unobstructed access to a workpiece in conformity to working conditions.

Yet another object of the invention is to provide a novel form of adjustable square comprising a framing square with orthogonal blades or limbs, slide fittings for the respective limbs, an adjustable angle blade for connection between the slide fittings and which can have its angle adjusted by movement of the fittings along the respective limbs, wherein each slide fitting has a slot for receiving the respective limb of the framing square, a locking pin with a headed end extending into the slot, the headed end being adapted for receipt in an elongate groove formed in the respective limb of the framing square and a nut threaded on the end of the pin opposite the headed end for tightening the fitting into a releasably clamped position on the respective limb of the framing square, and wherein one of the limbs of the framing square has an additional elongate groove whereby a further slide fitting can be mounted on said one limb, the further slide fitting having an additional orthogonal slot and locking pin assembly for sliding receipt of a further blade located in parallel to the other limb of the framing square and adjustable relative to said other limb by sliding adjustment of the further slide fitting along said one limb.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 8:
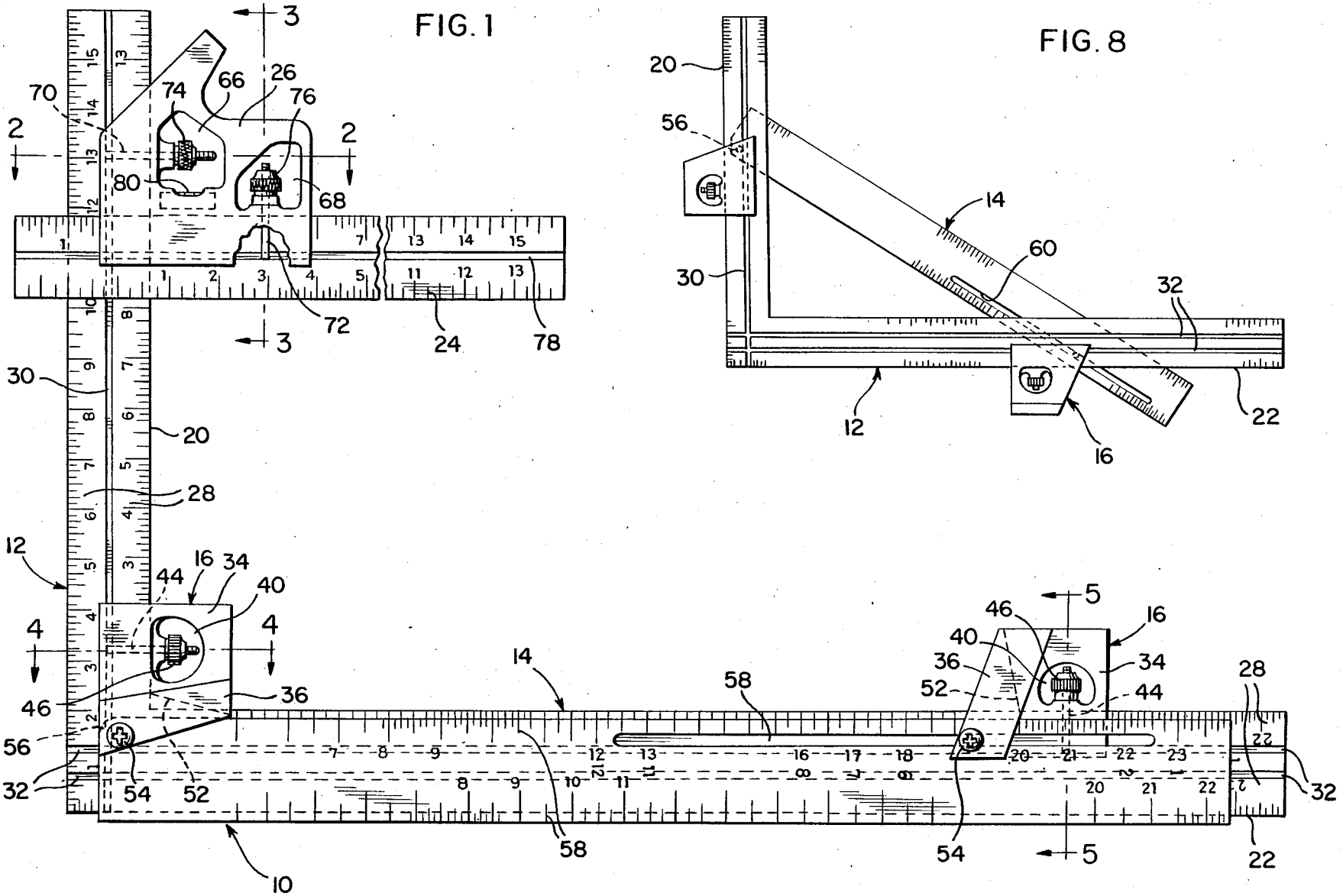
FIG. 1 is an elevational view of an adjustable layout square assembly in accordance with the invention.
FIG. 8 is a view similar to FIG. 7 showing the framing square and adjustable angle square assemblied in a different relative orientation.
Figure 2:
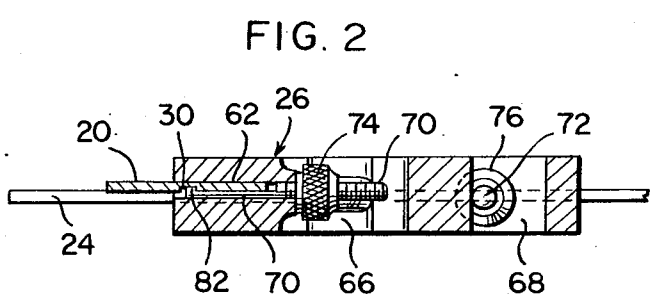
FIG. 2 is a sectional view on line 2—2 of FIG. 1.
Figure 3:
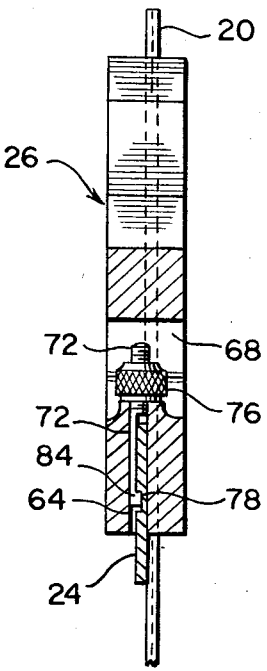
FIG. 3 is a sectional view on line 3—3 of FIG. 1.
Figure 4:
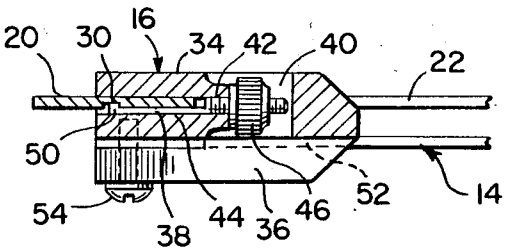
FIG. 4 is a sectional view on line 4—4 of FIG. 1.
Figure 5:
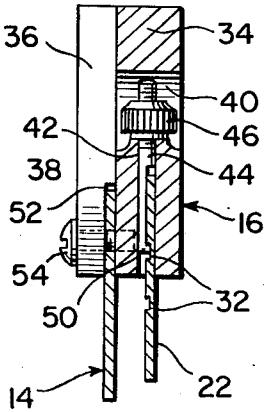
FIG. 5 is a sectional view on line 5—5 of FIG. 1.
Figure 6:
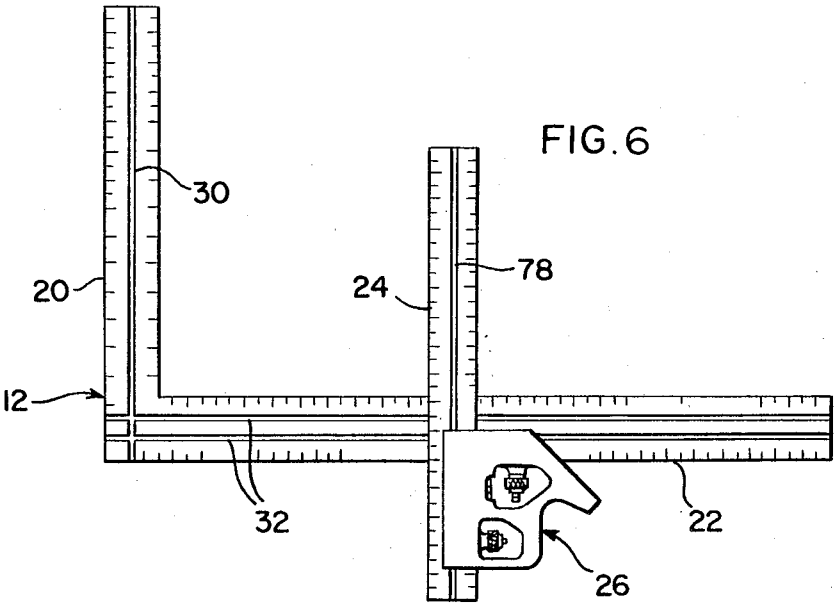
FIG. 6 is a reduced scale elevational view of certain parts of the layout assembly, notably a framing square and a tri-square in assembled working position.
Figure 7:
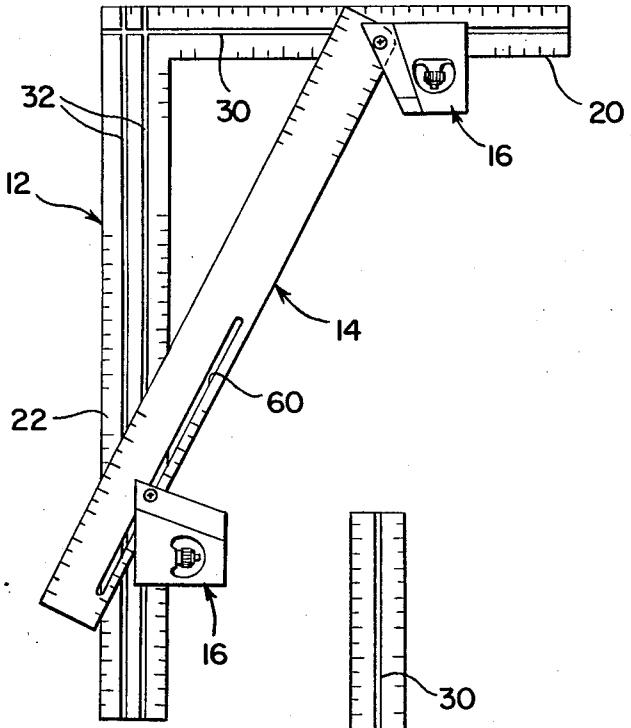
FIG. 7 is a reduced scale elevational view of other parts of the layout square assembly, notably the framing square and adjustable angle square in assembled position.

FIG. 1 of the drawings shows a completely assembled adjustable layout square device 10 in accordance with the invention comprising a framing square 12, an adjustable angle blade 14 connected between respective slide carriers or fittings 16 mounted for sliding on the respective limbs 20, 22 of the framing square, and a further tri-square blade 24 adjustably carried by a tri-square slide carrier or fitting 26 on one of the limbs 20 of the framing square so that the blade 24 is oriented in parallel with the other limb 22 of the framing square. FIG. 6 shows a subassembly of only the framing square 12 with tri-square slide carrier 26 and tri-square blade 24 while FIGS. 7 and 8 show a further subassembly, in respectively different orientations, of just the framing square, the adjustable angle blade 14, and the slide carriers 16.

Describing the components of the assembly in more detail, framing square 12 may be of generally conventional form, made in metal or other suitable material, and limbs 20, 22 may be marked with respective scales 28. Limb 20 has a single lengthwise groove 30 on one surface, the groove being equidistantly located from the opposite longitudinal edges of the limb. Limb 22 is wider than limb 20 and has a pair of lengthwise grooves 32 equivalent to groove 30. The grooves 32 are spaced from the respective longitudinal edges of limb 22 in conformity with the spacing of groove 30 from the edges of limb 20.

Slide carriers 16 are substantially similar in construction, but are left- and right-handed respectively. Each of the slide carriers may, for example, be formed from a block of suitable metal or the like of generally right trapezoidal shape with a main body section 34 and a thicker end section 36. A first slot 38 (FIGS. 4 and 5) is formed along the bottom portion of the slide carrier to mount same on a limb of the framing square, slot 38 being somewhat deeper than the distance between one of the grooves 30 or 32 and the respective edge of the relevant framing square limb, and slot 38 having a width sufficient to receive the respective limb. The body section 34 of the slide carrier is formed with an aperture 40 and a bore 42 extends from the base of slot 38 into the aperture. A pin 44 is received in the bore, pin 44 having a threaded outer end which receives an adjustment nut 46 and a cutaway section defining a head 50 adapted to fit into one of the grooves 30, 32 of the framing square. The arrangement is such that with pin 44 properly oriented, the slide carrier can be slid onto a respective limb of the framing square from one end of the limb, with the limb received in slot 38 and with head 50 of pin 44 received in a respective groove 30 or 32 as best seen in FIGS. 2–5. With the slide carrier adjusted to a required position along the limb of the framing square, nut 46 can be tightened down to releasably clamp the slide carrier in place.

Each slide carrier has a further slot 52 formed in the end section 36 for receipt of the adjustable angle blade 14, and a screw 54 received in suitably tapped apertures to extend across slot 52 and secure the blade. The adjustable angle blade, which may be of similar material to framing square 12 and may be marked with scales 58, has an aperture 56 at one end for receipt of screw 54 of one of the slide carriers and an elongate slot 60 at the other end for receipt of screw 54 of the other slide carrier. It will be readily understood that with the components of the assembly connected in this manner, movement of the slide carriers along the respective limbs of the framing square causes the angle of blade 14 to be adjusted, for example, for setting of run and pitch measurements, with the blade pivoting about screw 54 and lengthwise movement of the respective screw 54 along slot 60. FIG. 1, for example, shows the blade 14 positioned in substantial alignment with limb 22 of the framing square and FIG. 7 shows an adjusted angle. Also, the construction of the parts allows the slide carriers 16 to be mounted either on the inside edges of limbs 20, 22 as shown in FIGS. 1 and 7 or on the outside edges of the limbs as shown in FIG. 8 by suitable reversal of the components.

The tri-square slide carrier 26 comprises a suitably shaped metal body formed with orthogonally oriented slots 62, 64 (FIGS. 2 and 3) similar to slots 38 of the slide carriers 16, slots 62 and 64 being formed in adjacent planes so that one of the slots 62 or 64 can be adjustably received on a limb of the framing square and the other one of these slots can adjustably receive the tri-square blade 24 at right angles to the limb on which the carrier is mounted. For adjustable sliding movement and releasable clamping of the tri-square carrier along the respective limb of the framing square, and for similar adjustment of the tri-square blade in carrier 26, the carrier is provided with apertures 66, 68, pins 70, 72, and adjustment nuts 74, 76 which are formed to operate in slots 62, 64 in like manner to the pins 44 and nuts 46 of carriers 16, pins 70, 72 having headed ends 82, 84 which ride in the respective grooves 30, 32 in the limbs of the framing square and in an equivalent groove 78 in the tri-square blade. Tri-square carrier 26 may also be provided with a level-indicating bubble vial 80. The construction and configuration of carrier 26 is such that slots 62, 64 are reversibly usable in respect of the framing square limbs and tri-square blade. Further, the tri-square carrier can be mounted to operate either along the inner or outer edge or either one of the framing square limbs. By providing limb 22 of the framing square with plural grooves 32, the tri-square carrier can, for example, operate along the outer one of these grooves without interference to slide carrier 16 operating along the inner groove.

It will be readily appreciated from the foregoing that the invention accordingly provides an extremely versatile adaptable layout square assembly having various combinations and subcombinations that can be used together or separately for diverse layout and like purposes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An adjustable square assembly comprising a framing square having elongate orthogonally disposed limbs, one of said limbs having one elongate groove centrally located between respective inner and outer edges of the limb, the other of said limbs being wider than said one limb and having a pair of elongate grooves located at distances from respective inner and outer edges of said other limb conforming to the distance of said one elongate groove from the inner and outer edges of said one limb, a pair of slide carriers for receipt on the respective limbs, the slide carriers each having a slot for sliding receipt on the respective limb and a clamping pin with a head extending into the slot for receipt in one of said grooves for releasably clamping the slide carrier in place on the respective limb, an elongate adjustable-angle blade, means providing a pivot connection between one end of the blade and one of said slide carriers and means providing a sliding connection between the other end of the blade and the other of said slide carriers whereby the angle of the blade is adjusted by movement of the slide carriers along the respective limbs of the framing square, the slide carriers being selectively mountable on the respective limbs of the framing square for adjusting movement along the inner and outer edges thereof.

2. The invention as defined in claim 1 further including a tri-square body and an elongate tri-square blade, the tri-square blade having an elongate central groove, the tri-square body having a first slot for slidably mounting the tri-square body on one of the limbs of the framing square, a first clamping pin with a head extending into the first slot for engaging one of the grooves in the framing square to releasably clamp the tri-square body in place on the respective limb, the tri-square body having a second orthogonal slot in a plane adjacent the first slot for sliding receipt of the tri-square blade and a second clamping pin with a head extending into the second slot for releasably clamping the tri-square blade in place, the respective slots in the tri-square body being selectively usable in respect to the tri-square blade in the framing square, and the tri-square body being selectively mountable on the respective limbs of the framing square for sliding movement along the inner and outer edges thereof.

3. The assembly as defined in claim 1 wherein the means providing a pivot connection between the one end of the adjustable angle blade and said one of the slide carriers comprises an aperture in the blade receiving a screw on the carrier and wherein the means providing a sliding connection between the other end of the blade and the other of said slide carriers comprises a slot in the other end of the blade receiving the screw on the other slide carrier.

4. The assembly as defined in claim 3 wherein the slide carriers are of substantially similar left- and right-hand form reversible as to the connections with the adjustable angle blade.

5. The assembly as defined in claim 4 wherein each slide carrier includes a thicker end portion defining a further slot for receiving the respective end of the adjustable angle blade and wherein the respective screws extend across the further slots.

6. The asembly as defined in claim 2 wherein the respective clamping and adjustment pins each have a threaded end remote from the head and a nut threaded thereon for clamping the head in a respective groove of the framing square.

* * * * *